United States Patent [19]

Lang

[11] Patent Number: 4,716,436

[45] Date of Patent: Dec. 29, 1987

[54] CHARGE ERASE DEVICE WITH FLARE LIGHT CONTROL

[75] Inventor: Joseph H. Lang, Webster, N.Y.

[73] Assignee: Xerox Corporation, Stamford, Conn.

[21] Appl. No.: 833,313

[22] Filed: Feb. 26, 1986

[51] Int. Cl.[4] ..... G03G 15/052; G03G 21/00

[52] U.S. Cl. ..... 355/3 CH; 355/3 R

[58] Field of Search ..... 355/1, 3 R, 3 CH, 15; 362/84, 290

[56] References Cited

U.S. PATENT DOCUMENTS

| | | | |
|---|---|---|---|
| 3,511,563 | 5/1970 | Erwin | 353/38 |
| 3,687,538 | 8/1972 | Matsumoto | 355/3 |
| 3,792,913 | 2/1974 | Simmons | 355/7 |
| 4,105,321 | 8/1978 | Urso | 355/3 CH |
| 4,173,406 | 11/1979 | Oyama et al. | 355/3 R |
| 4,248,517 | 2/1981 | Nishikawa | 355/1 |
| 4,534,641 | 8/1985 | Gilliland et al. | 355/3 R |
| 4,557,581 | 12/1985 | Woolley et al. | 355/1 |

OTHER PUBLICATIONS

Brochure, "Light Control Film (LCF); 3M Industrial Optics; 12 pp.

"Brighter Displays With EL Lamps"; Douglas Bahniuk, Machine Design; Aug. 22, 1985; pp. 87–92.

*Primary Examiner*—Fred L. Braun

[57] ABSTRACT

An edge erase device is formed by joining an electroluminescent panel to a light control film to provide a sharper edge definition of the light impinging on a charged photosensitive surface. The light control film includes a plurality of micro-louvers which produce a venetian blind effect to preferentially direct the light from the lamp substantially eliminating the flare light.

3 Claims, 3 Drawing Figures

CHARGE ERASE DEVICE WITH FLARE LIGHT CONTROL

The invention relates to a device for removing residual charges on a photoreceptor used in an electrophotographic reproduction machine and, more particularly to an improved electroluminescent panel lamp which performs a margin erase function.

In xerographic type reproduction or printing machines, the machine photoreceptor is first charged in preparation for imaging. Thereafter, the charged photoreceptor is exposed to create, through selective discharge of the previously charged photoreceptor surface, a latent electrostatic image which is then developed, transferred to a suitable copy substrate material, and fused for fixed to provide a permanent copy. Following transfer of the developed image, the photoreceptor surface is cleaned by a cleaning brush or blade which removes any leftover developing material still on the photoreceptor surface. However, residual charges may still remain on the photoreceptor and these must be removed prior to recharging of the photoreceptor if the uniform controlled charge necessary for the xerographic process is to be obtained.

Heretofore, erasing devices for removing residual charges from the photoreceptor were typically filament lamps. More recent practice has been to use an electroluminescent panel lamp for this purpose. Electroluminescent panels are a preferred charge erase device because of their compact size and lower cost relative to other types of lamps. One problem with the panel lamps however, is that they act as a lambertian light source radiating flare light in all directions. The erase light impinging on the photoreceptor surface therefore lacks a sharp edge definition, resulting in a washout of the image a short distance into the information latent image frame.

The present invention provides an improved electroluminescent panel lamp which significantly reduces the flare light. More particularly, the invention is directed toward an illumination device for dissipating charge levels on selected areas of a previously charged photoconductive surface comprising, in combination:

an electroluminescent display panel, means for energizing said display panel to provide a light output from at least one surface thereof, a light control film optically coupled to said display panel, said film incorporating a plurality of micro-louvers which preferentially direct said panel light output onto said photoreceptor surface.

IN THE DRAWINGS

Figure 1:
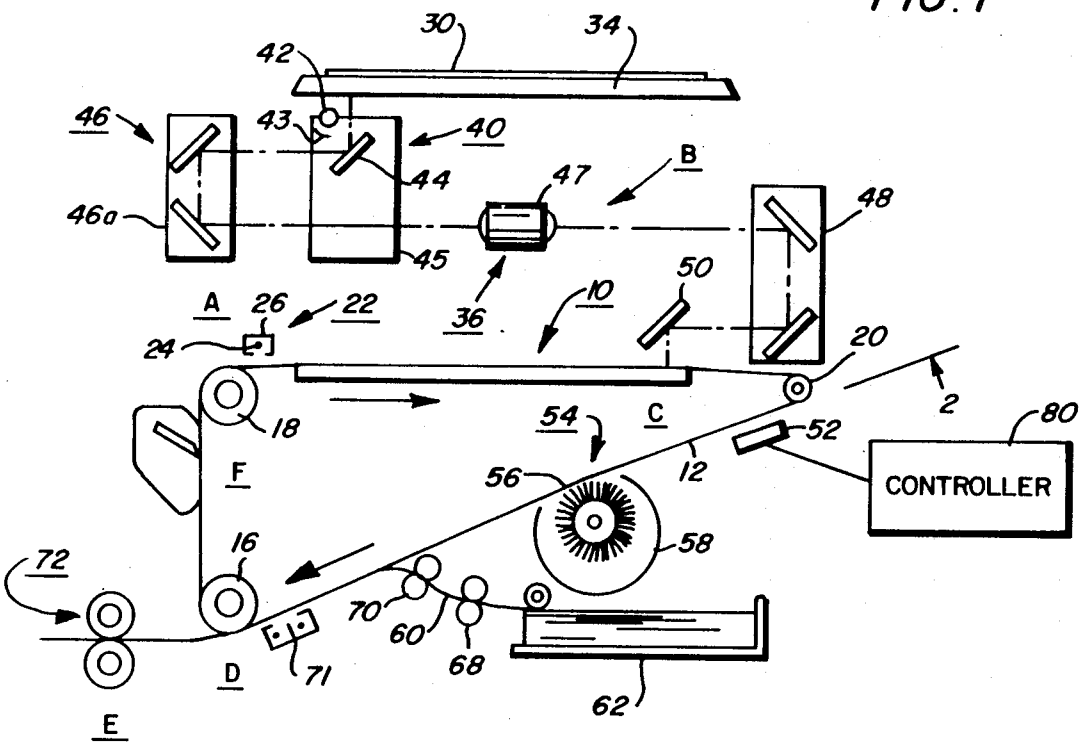
FIG. 1 is a side schematic view of an electrophotographic reproduction machine adapted to incorporate the erase device of the present invention.

For a general understanding of the features of the present invention, reference is made to the drawings. FIG. 1 schematically depicts the various components of an illustrative electrophotographic printing machine incorporating the charge erase device of the present invention therein. It will become apparent from the following discussion that this erase device is equally well suited for use in a wide variety of electrophotographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine uses a photoreceptor belt 10 having a photoconductive surface 12 formed on a conductive substrate. Belt 10 moves in the indicated direction, advancing sequentially through the various xerographic process stations. The belt is entrained about drive roller 18 and tension rollers 16, 20. Roller 18 is driven by conventional motor means, not shown.

With continued reference to FIG. 1, a portion of belt 10 passes through charging station A where a corona generating device, indicated generally by the reference numeral 22, charges photoconductive surface 12 to a relatively high, substantially uniform, negative potential. Device 22 comprises a charging electrode 24 and a conductive shield 26.

Figure 2:
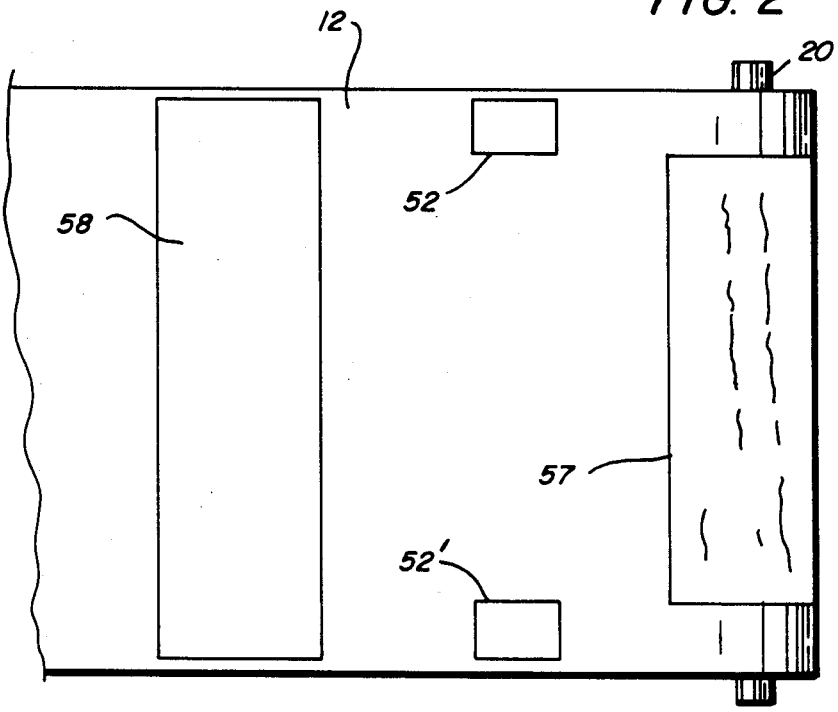
FIG. 2 is a top view of the portion of the FIG. 1 machine showing the photoreceptor belt.

As belt 10 continues to advance, the charged portion of surface 12 moves into exposure station B. An original document 30 is positioned, on the surface of a transparent platen 34. Optics assembly 36 contains the optical components which incrementally scan-illuminate the document from left to right and projects a reflected image onto surface 12 of belt 10 forming a latent image 37. Shown schematically, these optical components comprise an illumination scan assembly 40, comprising illumination lamp 42, associated reflector 43 and full rate scan mirror 44, all three components mounted on a scan carriage 45. The carriage ends are adapted to ride along guide rails (not shown) so as to travel along a path parallel to and beneath, the platen. Lamp 42 illuminates an incremental line portion of document 30. The reflected image is reflected by scan mirror 44 to corner mirror assembly 46 mounted on a second scan carriage 46A. Scan carriage 46A is mechanically connected to carriage 45 and adapted to move at ½ the rate of carriage 45. The document image is projected through lens 47 and reflected by a second corner mirror assembly 48 and by belt mirror 50, both moving at a predetermined relationship so as to precess the projected image, while maintaining the required rear conjugate, onto surface 12 to form thereon an electrostatic latent image corresponding to the informational areas contained within original document 30. Positioned between exposure station B and development station C and shown in top view in FIG. 2, are charge erase electroluminescent panel assemblies 52, 52'. The assemblies are positioned so as to illuminate and discharge edge margins adjacent the latent image frame 53. The construction and operation of assemblies 52, 52' is described in detail below.

At development station C, a magnetic brush development system, indicated generally by the reference numeral 54, advances an insulating development material into contact with the electrostatic latent image. Preferably, magnetic brush development system 54 includes a developer roller 56 within a housing 58. Roller 56 transports a brush of developer material comprising magnetic carrier granules and toner particles into contact with belt 10. Roller 56 is positioned so that the brush of developer material deforms belt 10 in an arc with the belt conforming, at least partially, to the configuration of the developer material. The thickness of the layer of developer material adhering to developer roller 56 is adjustable. The electrostatic latent image attracts the toner particles from the carrier granules forming a toner powder image on photoconductive surface 12.

Continuing with the system description, an output copy sheet 60 taken from a supply tray 62 is moved into contact with the toner powder image at transfer station D. The support material is conveyed to station D by a pair of feed rollers 68, 70. Transfer action D includes a corona generating device 71 which sprays ions onto the backside of sheet 60, thereby attracting the toner powder image from surface 12 to sheet 60. After transfer, the sheet advances to fusing station E where a fusing roller assembly 72 affixes the transferred powder image. After fusing, sheet 60 advances to an output tray (not shown) for subsequent removal by the operator.

After the sheet of support material is separated from belt 10, the residual toner particles and the toner particles of developed test patch areas are removed at cleaning station F.

Subsequent to cleaning, a discharge lamp, not shown, floods surface 12 with light to dissipate any residual charge remaining thereon prior to the charging thereof for the next imaging cycle.

A controller 80 incorporating a suitable microprocessor and memory, is provided for operating in predetermined timed relationships, the various components that comprise machine 10, insulating the energization of panel assemblies 52, 52', to reproduce the document 30 onto copy sheet 60, as will be understood by those familiar with the art. A suitable controller is disclosed in co-pending application Ser. No. 798,369 filed on Nov. 18, 1985, now U.S. Pat. No. 4,647,184, as a continuation of application Ser. No. 713,371 filed on Mar. 18, 1985, now abandoned, whose contents are hereby incorporated by reference. The energization of charge erase panel assemblies 52, 52' is accomplished by appropriately timed output signals from controller 80.

It is believed that the foregoing description is sufficient for purposes of the present application to illustrate the general operation of an electrophotographic printing machine incorporating the main feature of the present invention therein, e.g. the edge erase, electroluminescent panel assembly.

Figure 3:
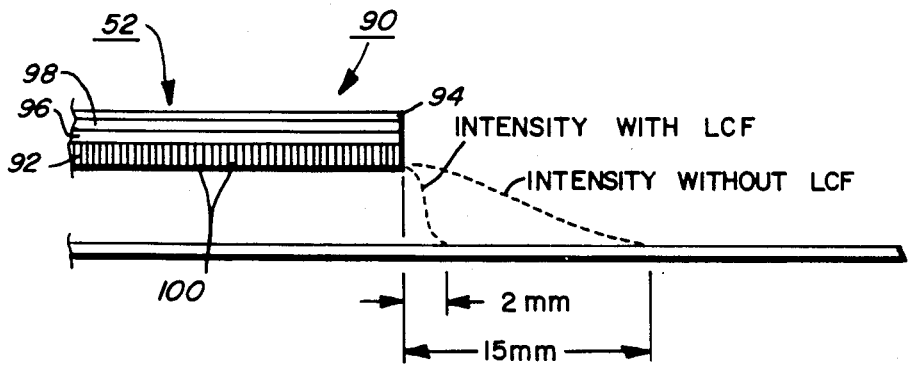
FIG. 3 is a side view of the erase device of the present invention.

Referring now to FIGS. 2 and 3, charge erase electroluminescent panel assemblies 52, 52' comprise an elongated generally rectangular electroluminescent panel 90 connected to a flare light control film 92 by a transparent doubleback tape or adhesive. Panel 90 comprises at least an opaque electrode 94, a clear electrode 96 and a zinc sulfide phosphor layer 98. The panel may be of either a thick or thin film design consructed and powered as described in, for example, an article entitled Brighter Displays With EL Lamps, pp. 87–92 in MACHINE DESIGN magazine, Aug. 22, 1985. Film 92, in a preferred embodiment, is a thin plastic sheet incorporating closely spaced mircoscopic louvers 100. Film 92 may be made using the processes disclosed in U.S. Pat. No. 3,511,563, whose contents are hereby incorporated by reference. The louvers have a depth which presents a 48 degree viewing angle to the light emanating from panel lamp 90. Viewing angle is the total wedge of light throughput and is a function of the louver depth. More depth gives narrower viewing angle; less depth gives wider viewing angle. As shown in FIG. 3, if panel 90 along were used to provide the erase energy, flare light from the panel would intrude a small distance into the image area. With the panel set at a distance of 2 mm from the photoreceptor surface, the flare light would extend 10–15 mm into the image frame washing out that portion of the image information. With the incorporation of film 92, the flare light intrusion was reduced to 2 mm. The panel's reflectiveness increases with decreased spacing from photoreceptor surface. Depending on system design, spacing of less than 2 mm may be possible.

Thus, it can be seen the panel assembly 52, 52' has effectively reduced the light dispersion of the electroluminescent lamp to make it a more direct source. the film, by virtue of the incorporation of the microlouvers acts as a venetian blind placed over the panel lamp.

While the erase device 52 has been described and shown herein as removing residual charges on the photoreceptor preparatory to recharging thereof, the erase device may also be used as an interdocument erase device to discharge or erase non-imaging areas of the photoreceptor 12 to prevent developing thereof. Typical of these photoreceptor nonimage areas are the charged but unused photoreceptor areas before the first document, between successive documents and after the last document. For this usage, the erase device would be located upstream of development station 54.

While the invention has been described with reference to the structure disclosed, it is not confined to the details set forth, but is intended to cover such modifications or changes as may come within the scope of the following claims:

What is claimed is:

1. An electrophotographic reproduction machine wherein a photoconductive surface is uniformly charged by a corona generating means and a latent image of an original document is subsequently formed on said photoconductive surface by an optical exposure system, said machine including at least one charge erase device for dissipating the charge on selected areas of the photoconductive surface exclusive of the area of said latent image, said charge erase device comprising, in combination, an electroluminescent display panel adapted to provide a light output from at least one surface thereof, and a light control film optically coupled to said display panel, said film adapted to direct said light output onto said photoconductive surface preferentially whereby flare light intrusion into the latent image area is minimized.

2. The reproduction machine of claim 1 wherein said light film incorporates a plurality of microlouvers which present approximately a 48 degree viewing angle to said panel light output.

3. The reproduction machine of claim 1 wherein said charge erase device is positioned with respect to said photoconductive surface such that said flare light intrusion is approximately 2 mm.

* * * * *